US006600119B1

(12) United States Patent
Freundt

(10) Patent No.: US 6,600,119 B1
(45) Date of Patent: Jul. 29, 2003

(54) POSITION INDICATING DEVICES AND POSITION LOCKING DEVICES FOR POWER CIRCUIT BREAKER SYSTEMS

(75) Inventor: Karsten Freundt, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/889,506

(22) PCT Filed: Jan. 14, 2000

(86) PCT No.: PCT/DE00/00174

§ 371 (c)(1),
(2), (4) Date: Jul. 18, 2001

(87) PCT Pub. No.: WO00/44015

PCT Pub. Date: Jul. 27, 2000

(30) Foreign Application Priority Data

Jan. 19, 1999 (DE) ..... 199 02 728

(51) Int. Cl.[7] ..... H01H 9/00
(52) U.S. Cl. ..... 200/308; 200/318; 200/321
(58) Field of Search ..... 200/50.32, 50.33, 200/50.37, 50.39, 308, 318, 321, 322, 330, 331

(56) References Cited

U.S. PATENT DOCUMENTS 5,847,340 A * 12/1998 Godesa ..... 200/331
6,433,290 B1 * 8/2002 Ulerich et al. ..... 200/308
6,437,262 B1 * 8/2002 Gupta et al. ..... 200/330

FOREIGN PATENT DOCUMENTS

| | | | |
|---|---|---|---|
| DE | 1 285 596 | 12/1968 | |
| DE | 44 45 081 C1 | 4/1998 | ..... H01H/33/42 |
| EP | 0 269 814 A1 | 6/1988 | ..... H02B/11/16 |

* cited by examiner

*Primary Examiner*—Michael Friedhofer
(74) *Attorney, Agent, or Firm*—Morrison & Foerster LLP

(57) ABSTRACT

Switch position indications and interlocks for power breaker circuits for air-insulated medium-voltage switchgear assemblies, having the functional features of power switching, disconnection and grounding. The switch position indications and interlocks are integrated jointly in control modules and are provided by indication slides and interlock slides which are guided in a center plate which is arranged between a front-face cover plate and a retaining plate facing the inner region of the power breaker systems, with the center plate having a number of guide openings matched to the positions and contours of the indication slides and of the interlock slides, the cover plate having a number of viewing openings matched to the positions and contours of the indication slides and of the interlock slides, and the retaining plate having a number of bushing openings matched to the positions and contours of the indication slides and of the interlock slides.

4 Claims, 1 Drawing Sheet

POSITION INDICATING DEVICES AND POSITION LOCKING DEVICES FOR POWER CIRCUIT BREAKER SYSTEMS

CLAIM FOR PRIORITY

This application claims priority to International Application No. PCT/DE00/00174 which was published in the German language on Jul. 27, 2000.

TECHNICAL FIELD OF THE INVENTION

The invention relates to switch position indications and interlocks for power breaker systems, and in particular, to air-insulated medium-voltage switchgear assemblies, having the functional features of power switching, disconnection and grounding.

BACKGROUND OF THE INVENTION

Power breaker systems are known in the conventional art and are designed in accordance with the relevant regulations or position indications for power breakers with their disconnector and grounding device functions in accordance with VDE 0670 Part 1000 and, for interlocks, the functions to be precluded at the same time in accordance with VDE 0670 Part 6 (interlocks/recommendations).

The position indications of power breaker systems and the functional interlocks are very largely controlled by individual lever linkages, as can be seen, for example, in DE 44 45 081 A1, and are therefore very closely matched to the design characteristics of the various power breaker systems. Depending on the nature and extent of the power breaker systems, widely differing control mechanisms with very different installation volumes are thus provided. The range of differing control mechanisms is correspondingly large as customer demands increase. In addition to the correspondingly required matching developments with design changes, of existing power breaker systems, complex new developments are also invariably required relating to switch position indications and interlocks for power breaker systems, in particular for newly developed system concepts.

SUMMARY OF THE INVENTION

In one embodiment of the invention, there is a switch position indication and interlock for power breaker circuits, control modules to jointly integrate the switch position indication and interlock, indication slides to provide the switch position indication and interlock. The control modules each have a center plate which guides the indication slides and the interlock slides and is arranged between a front-face cover plate and a retaining plate facing the inner region of the power breaker circuits, the center plate has a plurality of guide openings matched positions and contours of the indication slides and of the interlock slides, the cover plate has a plurality of viewing openings matched to the positions and contours of the indication slides and of the interlock slides, and the retaining plate has a plurality of bushing openings matched to the positions and contours of the indication slides and of the interlock slides.

In one aspect of the invention, the indication slides and the interlock slides move in straight lines in the center plate, the indication slides and the interlock slides are guided approximately at right angles to one another by the center plate, and the indication slides and the interlock slides are guided in the center plate in such a manner that, when the power breaker circuits are switched on, the indication slides block the interlock slides from moving.

In another aspect of the invention, the indication slides are associated with position states of the power breakers circuits, and the interlock slides are associated with function enabling states of disconnectors and grounding devices.

In still another aspect of the invention, the position states of the power breakers are symbolized by transverse and longitudinal bars on the indication slides, and the function enabling states of disconnectors and/or grounding devices are provided by the interlock slides by blocking or releasing bushings to drive shafts.

The invention relates to the large number of different designs for switch position indications and interlocks for the power breaker systems, and to significantly reduce the installation volume of these switch position indications and interlocks.

The invention has, for example, the following features:

the switch position indications and interlocks are integrated jointly in control modules, the switch position indications and interlocks are provided by indication slides and interlock slides, the control modules each have a center plate which guides the indication slides and the interlock slides and is arranged between a front-face cover plate and a retaining plate facing the inner region of the power breaker systems, the center plate has a number of guide openings matched to the positions and contours of the indication slides and of the interlock slides, the cover plate has a number of viewing openings matched to the positions and contours of the indication slides and of the interlock slides, and the retaining plate has a number of bushing openings matched to the positions and contours of the indication slides and of the interlock slides.

1.1 the switch position indications and interlocks are integrated jointly in control modules, 1.2 the switch position indications and interlocks are provided by indication slides and interlock slides, 1.3 the control modules each have a center plate which guides the indication slides and the interlock slides and is arranged between a front-face cover plate and a retaining plate facing the inner region of the power breaker systems, 1.4 the center plate has a number of guide openings matched to the positions and contours of the indication slides and of the interlock slides, 1.5 the cover plate has a number of viewing openings matched to the positions and contours of the indication slides and of the interlock slides, 1.6 the retaining plate has a number of bushing openings matched to the positions and contours of the indication slides and of the interlock slides.

The integration of switch position indications and switch position interlocks in a common control module provides the design preconditions for a standard control concept for power breaker systems, including those having different performance features. The control modules use what is referred to as a "sandwich" construction, with the switch position indications being in the form of indication slides, and the switch position interlocks being in the form of interlock slides. The indication slides and the interlock slides are in this case guided in a center plate, which is bounded at the front by a cover plate with corresponding viewing openings, and on the system side by a retaining plate having corresponding bushing openings. The control module is designed as a compact unit, and can be used as a standardized assembly in power breaker systems, irrespective of their power range.

Additional features of the invention provide:

the indication slides and the interlock slides can move in straight lines in the center plate, the indication slides and the interlock slides are guided approximately at right angles to one another by the center plate, and the indication slides and the interlock slides are guided in the center plate in such a manner that, when the power breakers are switched on, the indication slides block the capability of the interlock slides to move.

The straight-line guidance of the indication slides and of the interlock slides in the center plate provides a blocked state and a released state for the interlock slides in a particularly simple manner.

Other features of the invention provide the following:

the indication slides are associated with position states of the power breakers, and the interlock slides are associated with function enabling states of disconnectors and grounding devices.

This fixed association with the various components of the power breaker systems allows operations to be carried out in switching consoles more easily and substantially without errors.

Additional features of the invention are provided by the following:

the position states of the power breakers are symbolized by transverse and longitudinal bars on the indication slides, and the function enabling states of disconnectors and grounding devices are provided by the interlock slides by blocking or releasing bushings to drive shafts.

The very high level of operation without errors in switching consoles is, in addition, also promoted by these features.

BRIEF DESCRIPTION OF THE DRAWINGS

The invention will be explained in more detail using an exemplary embodiment which is illustrated in two figures, in which.

DETAILED DESCRIPTION OF THE PREFERRED EMBODIMENTS

Figure 2:
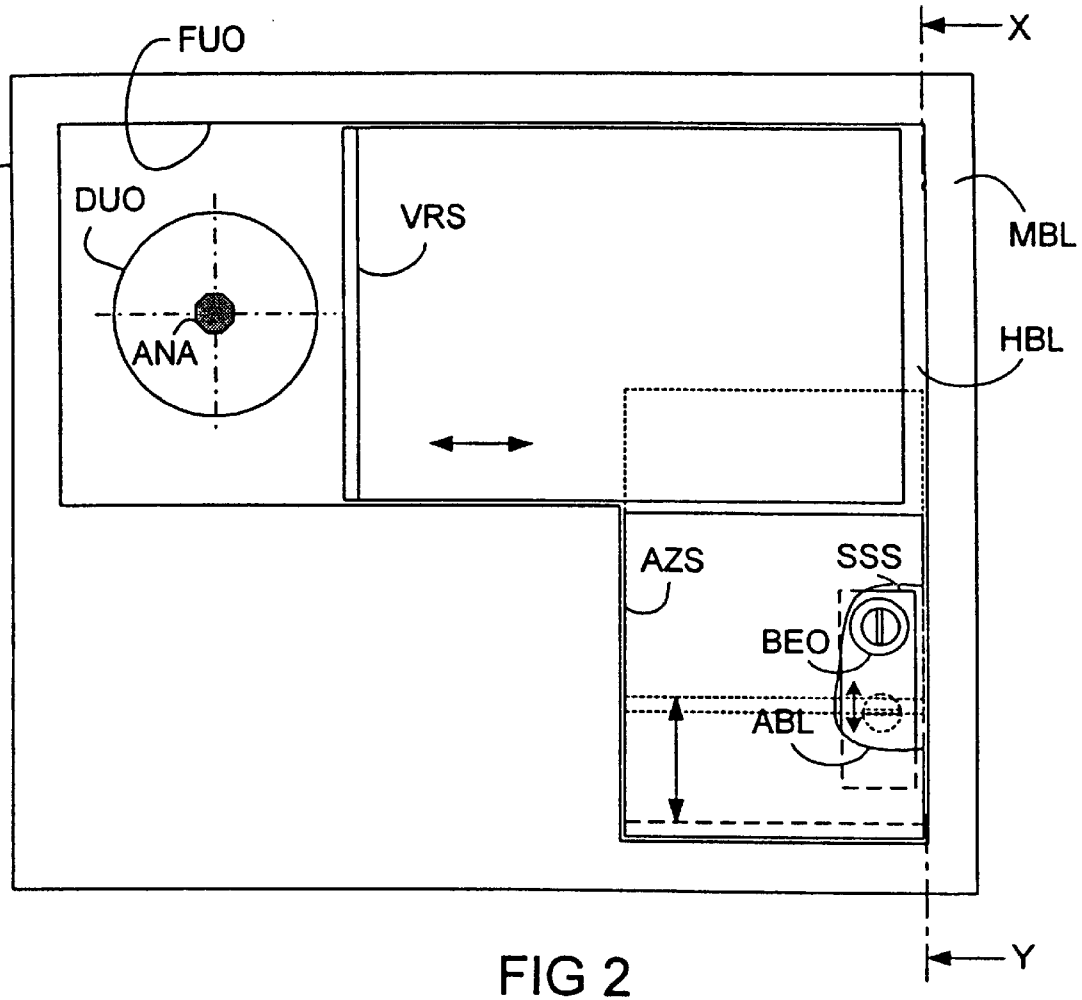
FIG. 2 shows the front view of the control module with the cover plate removed.
Figure 1:
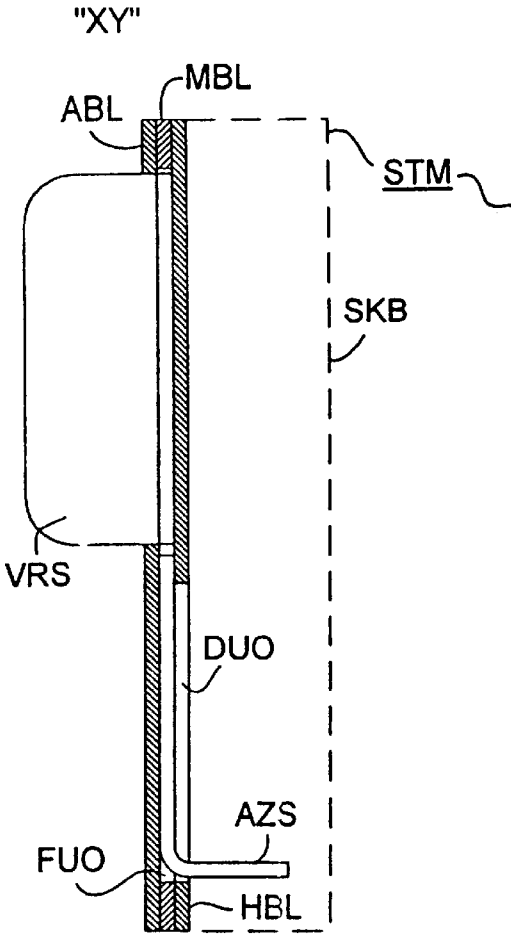
FIG. 1 shows a section end view of the control module.

FIG. 1, which shows a section view of the control module STM along the section line X, Y in FIG. 2, shows the sandwich construction of the control module STM in a particular way. The control module STM has the center plate MBL, in whose recesses the indication slide AZS of a power breaker not shown, and the interlock slide VRS for the disconnectors and grounding devices, which are likewise (not shown) are guided. The center plate MBL is bounded at the front by the cover plate ABL, and on the system side by the retaining plate HBL. The dashed lines indicate the control component area SKB, in which the switching linkages required to control the power breakers and the grounding devices and disconnectors are arranged in a corresponding three-dimensional manner.

Furthermore, this view shows the guide opening FUO in the center plate MBL, and the bushing opening DUO in the retaining plate HBL.

FIG. 2 shows the control module STM with a partial detail of the cover plate ABL, with the viewing opening BEO. The center plate MBL, with the retaining plate HBL behind it, is located behind the cover plate HBL. The center plate MBL has the guide opening FUO in which the interlock slide VRS and the indication slide AZS can each be moved in the direction of the arrow. In the illustrated state, the indication slide AZS is positioned such that the interlock slide VRS can be moved in the direction of the arrow. The interlock slide VRS and the indication slide AZS are arranged in the center plate MBL such that, when the power breakers are switched on, movement of the indication slides ASZ easily results in the interlock slides VRS being blocked. Thus, for example, the interlock slide VRS is blocked in both movement directions by the transverse bar (which can be seen in the viewing opening BEO in the cover plate ABL) of the switch position symbol SSS on the indication slide AZS—the power breaker is not switched—and the bushing opening DUO is thus closed, as is access to the drive shaft ANA for the disconnectors and grounding devices. When—as illustrated—the power breaker is in the switched on state, in which the vertically arranged longitudinal bar can be seen in the viewing opening BEO in the cover plate ABL, is the blocking of the interlock switch VRS canceled, thus allowing access to the drive shaft ANA of the disconnectors and grounding devices by movement of the interlock slide VRS. The disconnector and grounding-device contacts can thus be moved manually in this state.

What is claimed is:

1. A switch position indication and interlock for a power breaker circuit, comprising:

a control module to jointly integrate the switch position indication and the interlock;

an indication slide to provide the switch position indication; and an interlock slide to provide the interlock, wherein the control module has a center plate which guides the indication slide and the interlock slide and is arranged between a front-face cover plate and a retaining plate facing an inner region of the power breaker circuit, the center plate has a plurality of guide openings matching positions and contours of the indication slide and of the interlock slide, the cover plate has a plurality of viewing openings matching the positions and the contours of the indication slide and of the interlock slide, and the retaining plate has a plurality of bushing openings matching the positions and the contours of the indication slide and of the interlock slide.

2. The switch position indication and interlock as claimed in claim 1, wherein the indication slide and the interlock slide move in straight lines in the center plate, the indication slide and the interlock slide are guided approximately at right angles to one another by the center plate, and the indication slide and the interlock slide are guided in the center plate in such a manner that, when the power breaker circuit is switched on, the indication slide blocks the interlock slide from moving.

3. The switch position indication and interlock as claimed in claim 1, wherein the indication slide is associated with a position state of the power breaker circuit, and the interlock slide is associated with a function enabling state of a disconnector and a grounding device.

4. The switch position and interlock as claimed in claim 3, wherein the position state of the power breaker is symbolized by transverse and longitudinal bars on the indication slide, and the function enabling state of at least one of the disconnector and the grounding device is provided by the interlock slide by blocking or releasing bushings to drive shafts.

* * * * *